United States Patent [19]

Del Bon et al.

[11] 4,442,959

[45] Apr. 17, 1984

[54] SELF-CLOSING VALVE-AND-LID ASSEMBLY

[76] Inventors: Luigi Del Bon, Feldstrasse 141; Franco Del Bon, Feldstrasse 139, both of 4663 Aarburg, Switzerland

[21] Appl. No.: 259,158

[22] Filed: Apr. 30, 1981

[51] Int. Cl.[3] ..... B65D 83/14

[52] U.S. Cl. ..... 222/402.24; 222/513

[58] Field of Search ..... 222/402.1, 402.13, 402.15, 222/402.21, 402.22, 402.23, 402.24, 511, 512, 513, 514, 518; 251/120, 170, 390

[56] References Cited

U.S. PATENT DOCUMENTS

| | | | |
|---|---|---|---|
| 2,696,934 | 12/1954 | Ashton | 222/402.24 |
| 2,845,203 | 7/1958 | Potash | 222/514 |
| 2,863,699 | 12/1958 | Elser | 222/514 |
| 3,540,634 | 11/1970 | Mayercik | 222/402.21 |
| 3,613,728 | 9/1969 | Steiman | 222/402.24 |

*Primary Examiner*—F. J. Bartuska

*Attorney, Agent, or Firm*—Heinrich W. Herzfeld

[57] ABSTRACT

A valve-and-lid assembly adapted for closing off the open top end of a pressurized container comprises a lid having a dome part protruding on an upper or lower face of the lid and having a central opening. A valve disc of elastically resilient material is lodged in the dome part and extends with a valve head part thereof through the central opening. The latter is surrounded by an axially extending collar portion of the dome part depending from a flat top wall of the latter and having an annular rim about the opening which is in sealing contact with a contact face of the valve head when the valve is closed, thereby obturating product ducts provided in the valve disc. Pressure on the face of the valve disc opposite the valve head by means of a tubulure or the like actuating means, which can carry a conventional atomizer head or filling head, moves the contact face of the valve head away from the collar portion rim and opens free communication between the interior of the container covered by the lid and the interior of the tubulure.

25 Claims, 18 Drawing Figures

LP
CA
P1
P2
-5-
-30-
-27-

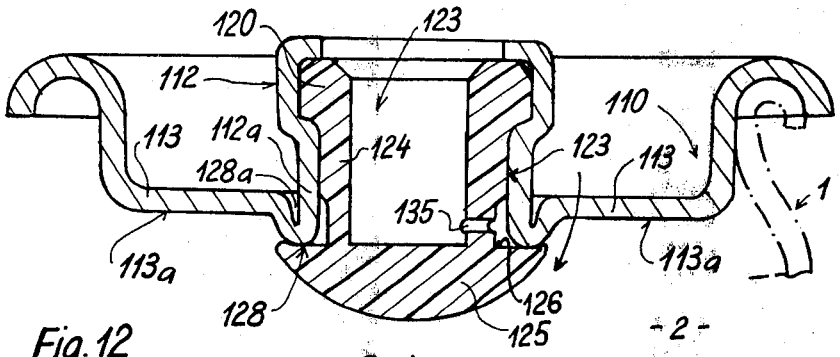
Fig. 12
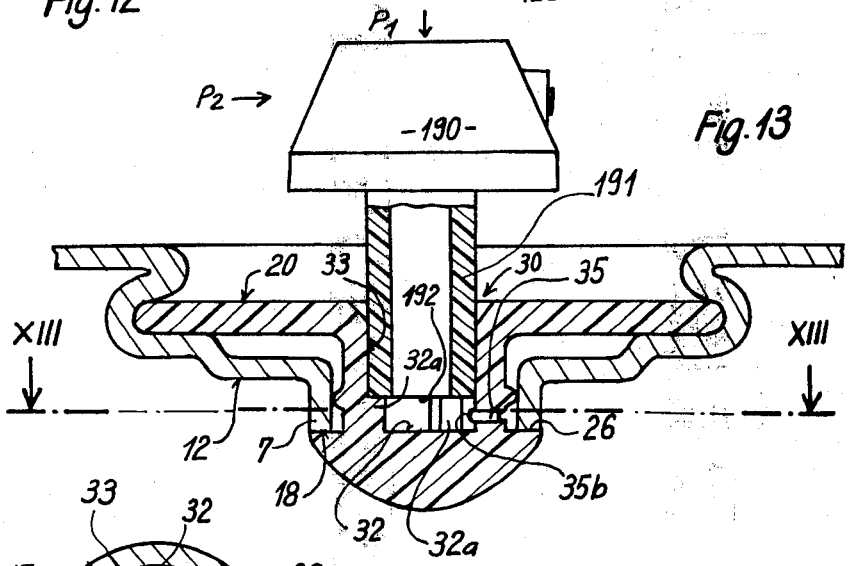
Fig. 13
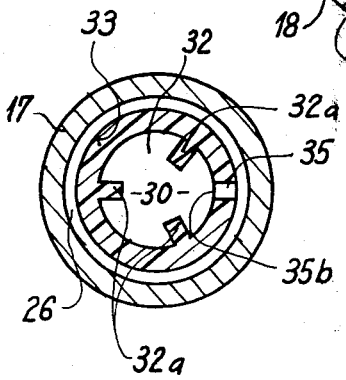
Fig. 14
Fig. 15
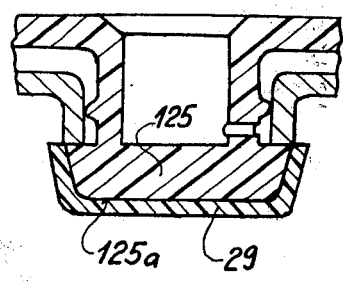

SELF-CLOSING VALVE-AND-LID ASSEMBLY

BACKGROUND OF THE INVENTION

This invention relates to a self-closing valve-and-lid assembly adapted for closing the open top end of a container fillable with pressurized product. It also refers to a novel lid and valve disc, both of which are suitable for being used in the novel valve-and-lid assembly.

Valve-and-lid assemblies which are used to close the open top end of a can or the like container, especially such container destined to be filled with a preferably liquid product and a pressurizing agent, are well known in the art of aerosol cans and are described in numerous patents and other publications.

For instance, German Offenlegungsschrift No. 27 22 265 of George Bernard Diamond describes a pressurized can which is closed off at the top by a lid, preferably of metal such as aluminium, and which is equipped with a discharge valve mounted in the center of the lid, on a common central axis of the valve-and-lid assembly.

The valve is provided with a product passage, a valve disc or plate having a central opening, and with a valve body which cooperates with the valve disc to obturate the product passage when the valve is in closed position; at least one of the two aforesaid valve elements is usually made of an elastically resilient material.

The lid comprises a centrally located dome part which protrudes, in the shape of an inverted cup or bell, from a main lid plane in which a flat part of the lid surrounding the dome part extends, and which plane extends radially to the above-mentioned central axis. The dome part is provided with a central opening axially with that of the valve disc and is crimped or stamped in another suitable manner to hold the peripheral zone of the valve disc in a fast, liquid- and gas-tight manner. The periphery of the lid is sealingly connected with a top rim of the container sidewall surrounding the said container top opening, and extends generally to the said central assembly axis.

The lid including the dome part thereof must usually be rigid under conditions of filling product (and, of course, propellant of such is used) into, and of discharging product (and propellant) from the container.

When opening the valve, the valve disc and valve body are so changed in their position relative to one another that there opens a gap between them which permits the flow of product through the product passing of the valve to the outside.

However, in this known valve and all others that have come to our knowledge, the manufacture of the movable part, i.e. the valve body which carries a valve stem and on the latter often an atomizer head, is relatively complicated, especially when it is to be manufactured by means of modern injection molding techniques. Moreover the known valves often require costly spring means for biassing the valve body into its closing position.

It is another drawback of known valve-and-lid assemblies that insertion of a sleeve or stem part of an atomizer head or of a filling head used for introducing product and/or propellant into the interior of a container leads frequently to damage of parts of the valve, especially the small elastically resilient valve disc or gasket that these valves usually require.

OBJECTS AND SUMMARY OF THE INVENTION

It is, therefore, an object of the present invention to provide a valve-and-lid assembly, the manufacture of which is simpler than that of the known assemblies and which requires a minimum number of parts, each of which is in itself easy to manufacture.

It is another object of the invention to provide a valve-and-lid assembly in which spring means can be dispensed with and which nevertheless guarantees satisfactory sealing and operation of the valve.

A further object of the invention is to provide a valve-and-lid assembly in which an atomizer head stem or sleeve or a filler head can be introduced easily without damaging any sensitive parts thereof such as an elastically resilient gasket.

These and other objects of the invention which will become apparent from the following description thereof, are attained in accordance with the invention in the initially described self-closing valve-and-lid assembly, which comprises:

(1) a lid the periphery of which is adapted for being sealingly connected with a top rim of a container sidewall surrounding the container top opening, and extending generally transverse to the central assembly axis, which lid has a central dome part and a central opening in the middle of the dome part, and is rigid under conditions of filling product into, and discharging product from said container;

which lid has a flat lid part about the dome part and extends generally in a main lid plane transverse to the central assembly axis, while the dome part has a top wall and a circumferential sidewall which latter extends generally out of the main lid plane, and comprises a collar portion extending axially relative to the central assembly axis and ending in an annular rim about the central dome part opening, which collar portion protrudes from the flat lid part on the side thereof destined to face toward the interior of a container, below the said main lid plane; and (2) a valve disc being elastically resilient under the above-defined conditions, and preferably having a peripheral disc zone which is firmly clamped in said central dome part, which valve disc has an outer face adapted for facing away from the container and an opposite underside face adapted for facing toward the interior of the container, and comprises a valve head depending from the underside face of the disc and extending through the central opening of the dome part to outside the collar portion, which valve head has a sidewall and a contact face which, in closed state, is in sealing contact with at least the said collar portion below the main lid plane, and which valve head further comprises at least one duct having an orifice in the outer face of the valve disc and another orifice in the said sidewall of the valve head above the contact face thereof; and (3) finger-engageable actuating means for deforming the valve disc in a manner such that the said contact face is moved out of engagement with the collar portion of the lid dome part thereby opening a free passage through at least one duct from outside the stem zone to outside the outer disc face.

In a preferred embodiment of the valve-and-lid assembly according to the invention, the valve head comprises (a) a reduced radial diameter stem part depending from the underside face of the valve disc and extending axially relative to the central assembly axis, (b) a valve head button at the lower end of the stem part being of larger radial diameter than the stem part, and (c) an annular shoulder on the valve head button facing toward the collar portion and constituting the said contact face of the valve head, while the said other orifice of the duct is provided in the stem part sidewall.

In preferred embodiments of the valve-and-lid assembly according to the invention, the dome part of the lid protrudes downwardly from the main lid plane, depending from the flat lid part on the side of the latter which is turned toward the interior of the container the open end of which is closed off by the lid.

More particularly, in preferred embodiments, the circumferential sidewall of the dome part of the lid comprises an annular crimped region firmly clamping a peripheral zone of the valve disc; and the dome top wall is vaulted away from the main lid plane below the crimped sidewall region to provide a hollow space between the vaulted top wall and the underside face of the valve disc which is lodged inside the clamped-in peripheral zone of the disc.

In an especially preferred embodiment, the distance of the annular shoulder on the valve head button from the underside face of the valve disc, prior to being mounted in the valve-and-lid assembly, is shorter than the distance between the same two disc elements when the disc is mounted in the dome part, thereby imparting a bias to the annular shoulder against the annular rim of the collar portion, and obtaining a stronger sealing effect.

At the same time, in this embodiment, the whole valve disc can be so firmly held in place, that the above-mentioned crimped fold of the dome part clamping-in the periphery of the valve disc can be dispensed with.

While, in preferred embodiments of the valve-and-lid assembly of the invention, the dome part protrudes downwardly from the flat lid part toward the interior of the container, the dome part can also protrude upwardly, from the main lid plane, thus rising above the flat lid part on the outside, above the outer face of the latter; in this case, the collar portion consists of an annular bead means about said central opening of said dome part and protrudes downwardly out of the main lid plane on the underside of the flat lid part which is turned toward the interior of the container.

In another aspect, the invention provides a container lid which is usable in the above described self-closing valve-and-lid assemblies, the periphery of the lid being adapted for sealing connection with a top rim of a container sidewall surrounding the container top opening, which lid has a central dome part and a central opening in the middle of the dome part, and is rigid under conditions of filling product into, and discharging product from said container, and is preferably made of metal;

the lid has a flat lid part, about the dome part, extending generally in a main lid plane transverse to the central assembly axis, and the dome part has a top wall and a circumferential sidewall which latter extends generally out of the main lid plane, and comprises a collar portion which extends axially relative to the central lid axis and ends in an annular rim about the central dome part opening;

and the collar portion extends from the dome part downwardly away from the main lid plane on the side of the lid destined to face toward the interior of the container.

Preferably, the whole dome part protrudes from the flat lid part on the side of the latter destined to face toward the interior of the container. If it does not, at least the collar portion should always do so.

In yet another aspect, the invention provides a novel valve disc adapted for being mounted in a self-closing valve-and-lid assembly according to the invention, which valve disc is of a material which is elastically resilient under conditions of filling product into, and discharging product from the container, and has an outer face destined to face away from the container and an opposite underside face which is to face toward the interior of the container;

this valve disc comprises a valve head depending from the underside face of the disc and having a sidewall and bearing a contact face which, in closed state, is adapted to be brought in sealing contact with the rigid contact means of the lid in which the valve disc is destined to be mounted; the valve head further comprises at least one duct having an orifice in the outer disc face and another orifice in the said sidewall of the valve head above the contact face thereof.

Preferably, the valve disc consists of a synthetic resin material selected from the group consisting of a polyester elastomer of the Hytrel 4055 type and an ethylene-vinyl acetate copolymer resin of the Elvax 3120 type.

Elvax 3120 is an ethylene-vinyl acetate copolymer resin made by E. I. Dupont De Nemours, Wilmington, Del., it contains 7.5 weight-% of vinyl acetate units and has a density of 0.93 g/cm$^3$ and a melt index of 1.2 g/10 min (ASTM D-1238), while the even more preferred polyester elastomer Hytrel 4055, which is also made by Dupont, has a melting point of 168° C., a softening point of 112° C., a density of 1.17 and a tensile strength of 415 kg/cm$^2$. Further details about these substances can be found in pamphlets of the above-mentioned American company.

BRIEF DESCRIPTION OF THE DRAWINGS

Further objects, interesting features and other details of the invention will become apparent from the following description of preferred embodiments of the invention in connection with the accompanying drawings in which

FIG. 12 shows a similar view of a fifth embodiment of the valve-and-lid assemblfy of the invention;

FIG. 13 is an axial sectional view of the embodiment of FIG. 1, and an atomizer head as actuating means; and FIG. 14 is a cross sectional view of the same embodiment, taken in a plane indicated by XIV—XIV in FIG. 12;

FIG. 15 is a view similar to FIG. 1 but with a protection cover for the valve head button;

Figures 1, 2:
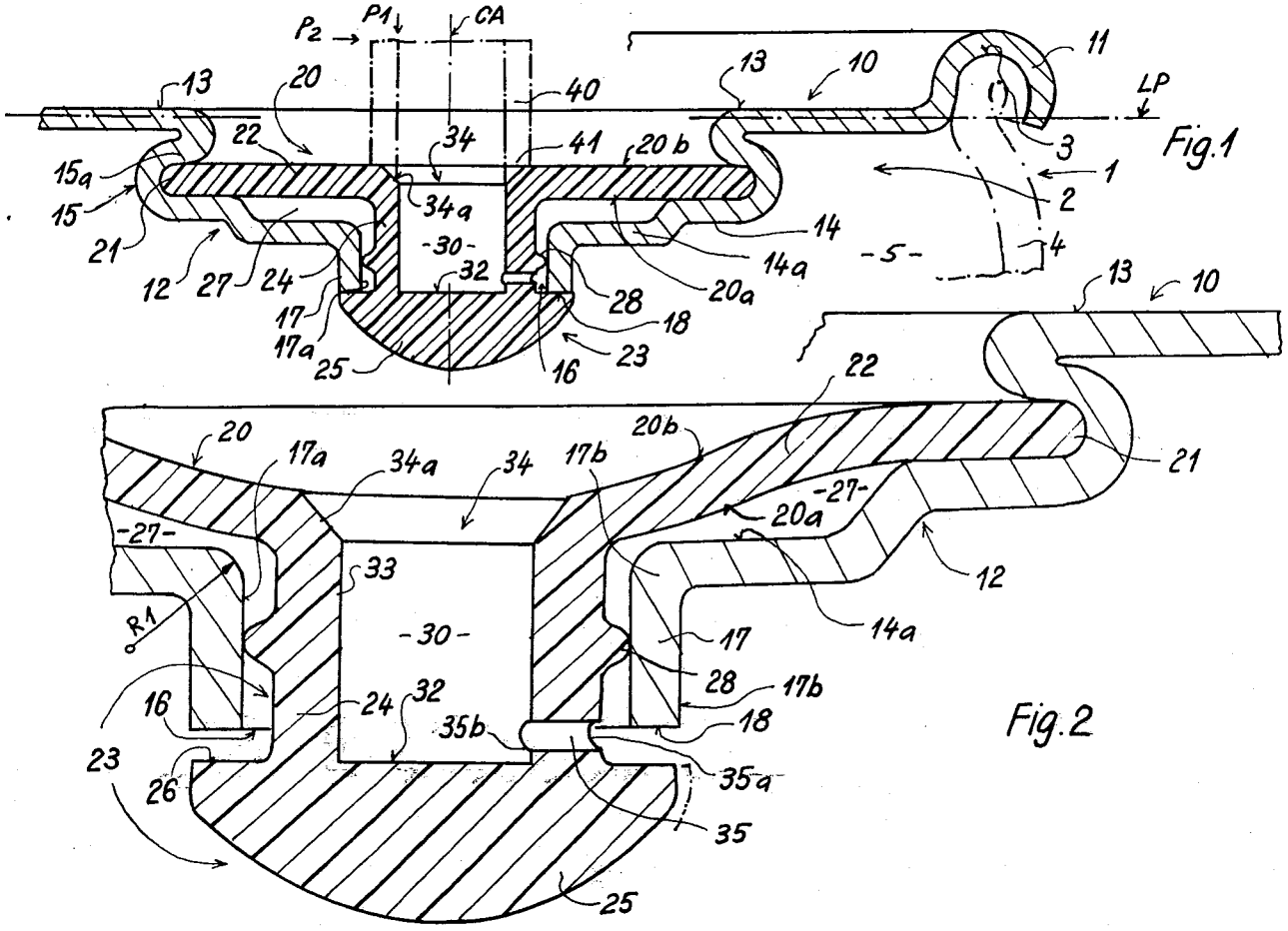
FIG. 1 is a sectional view, taken in a plane through the central assembly axis, of a first, preferred embodiment of the valve-and-lid assembly of the invention, with the part in closed position, but without the actuating means.
FIG. 2 is a similar view of the same embodiment, with parts in open or discharge position.

In the preferred embodiment of a valve-and-lid assembly according to the invention shown in FIGS. 1 and 2, the lid 10 closes a can or the like container having an open end 2 at the top thereof which open end is surrounded by a top rim 3 of a can sidewall 4. The periphery 11 of the lid 10 is sealingly connected to can rim 3, thus closing off the interior 5 of can 1, which can be filled with a liquid product under pressure by a propellant.

The lid 10 has a central dome part 12 which is surrounded by a flat lid part 13, extending in a main lid plane LP which is radial to a central assembly axis CA. The dome part 12 protrudes from the lid plane LP downward toward the interior 5 of can 1.

The dome part 12 has a top wall 14 and a circumferential sidewall 15, as well as a central opening 16 in the top wall 14 which is surrounded by an axially downwardly extending collar portion 17 that depends from the dome top wall 14. At its lower, free end the rim 18 of collar portion 17 serves as a contact and sealing element to be engaged by a corresponding portion of a valve disc.

The sidewall 15 of the dome part 12 comprises an annular region 15*a* which is crimped to firmly clamp in a peripheral zone 21 of a valve disc 20. The latter has a disc part 22 which extends across the base of dome part 12 and bears on its underside face 13, turned toward the interior 5 of can 1, a valve head 23 which depends from underside face 20*a* to extend axially through the central dome opening 16 and to end beneath the rim 18 of collar portion 17.

The valve head 23 shown in FIGS. 1 and 2 comprises a stem part 24, of reduced radial diameter, which depends from the central portion of valve disc 20 and bears at its lower end, at the level of collar portion rim 18, a valve head button 25 of larger radial diameter than the stem part 24. Thus there is formed at the junction of parts 24 and 25 a shoulder 26 which, in the embodiment of FIGS. 1 and 2, extends in a plane parallel to the main lid plane LP.

In the central region of the top wall 14 of dome part 12 the top wall region 14*a* is vaulted further away from the main lid plane LP so as to provide a hollow space 27 between the inner surface of vaulted top wall region 14*a* and the underside face 20*a* of valve disc 20.

The valve head 23 is further provided with an annular sealing rib 28 which protrudes radially from the outer surface of stem part 24 and engages the opposite inner wall surface 17*a* of collar portion 17 slidingly and sealingly at all times.

In the embodiment of FIGS. 1 and 2, the valve head 23 has a cavity 30 therein which has a bottom 32 and is enclosed by a sidewall 33 of stem part 24 and has a top opening 34 in outer valve disc face 20*b*. A duct 35 extends through the stem part 24 from a first, entry orifice 35*a* in the outside wall surface 24*a* of stem part 24 to a second, exit orifice 35*b* in the sidewall 33 of cavity 30.

The actuating means of this embodiment is indicated by phantom lines in FIG. 1. It can be a tubular sleeve 40, for instance, of an atomizer head of the type used conventionally with spray cans. The lower end 41 of sleeve 40 can be tapered and fit in the correspondingly bevelled rim 34*a* about cavity openings 34 in top face 20*b* of valve disc 20.

When finger pressure is exercised on the actuating means comprising sleeve 40, in axial direction as indicated by arrow $P_1$, then the central region of valve disc 20 together with valve head 23 is moved downward to a position as shown in FIG. 2. In this "open" position, obturating shoulder 26 of valve head button 25 has moved out of engagement with rim 18 of collar portion 17 and frees a path for product (and optionally propellant) from the can interior 5 into entry orifice 35*a* of duct 35, and through duct 35 via exit orifice 35*b* into cavity 30 and further through central passage 42 of actuating sleeve 40, which registers with the cavity 30, on to the spray nozzle (not shown) of an atomizing head mounted on sleeve 40.

At the same time, sealing rib 28 remains constantly in sealing contact with the inner wall surface 17*a* of collar portion 17, thus preventing penetration of product into the space 27, in which product could age and dry up and thus impede proper actuation of the valve disc 20. It is therefore particularly important that the entry orifice 35*a* of duct 35 is located between shoulder 26 and sealing rib 28 of the valve head 23.

Pressure can also be applied in transverse, tilting direction as indicated by arrow $P_2$.

Of course, several ducts 35 can be provided, in particular, regardless of whether the valve is to be opened by axial finger pressure (Arrow $P_1$) or by tilting (Arrow $P_2$).

The space 27 between valve disc 20 and the inner face of the vaulted dome top wall region 14*a* facilitates downward deformation of valve disc 20 as shown in FIG. 2. The radius $R_1$ of the curvature at the junction 17*b* of dome top wall region 14*a* and collar portion 17 must be large enough to avoid too early an abutment of the underside disc face 20*a* against the junction 17*b*. This junction can also be provided with an annular bevel (not shown).

An important advantage of the structure of the embodiment shown in FIGS. 1 and 2 resides in the fact that pressure prevailing in the can interior 5 acts upon the rounded end surface of valve head button 25 in a direction which enhances the sealing pressure of button shoulder 26 against the contact rim 18 of collar portion 17.

Another important advantage resides in the fact that the important deformable portions of the valve disc do not come into contact with the liquid product in, or being discharged from the can 1, but remain in contact with air only. Deformation of the valve disc 20 and also axial lengthening of the stem part 24 in the "open" position are facilitated by the polymer fiber structure of the deformable element. This axial lengthening occurs particularly when deforming "opening" pressure is exercised directly on the bottom 32 of cavity 30 (see the description of FIGS. 12 and 13 below).

A further advantage of the valve-and-lid assembly, especially as shown in FIGS. 1 and 2, resides in the facility of filling the can 1 through the assembly which is already mounted in place across the can opening 2, avoiding damage to the valve parts.

The elastic nature of the wall of stem part 24 also enhances the sealing effect of annular sealing rib 28 on the inner wall 17*a* of collar portion 17.

Figure 3:
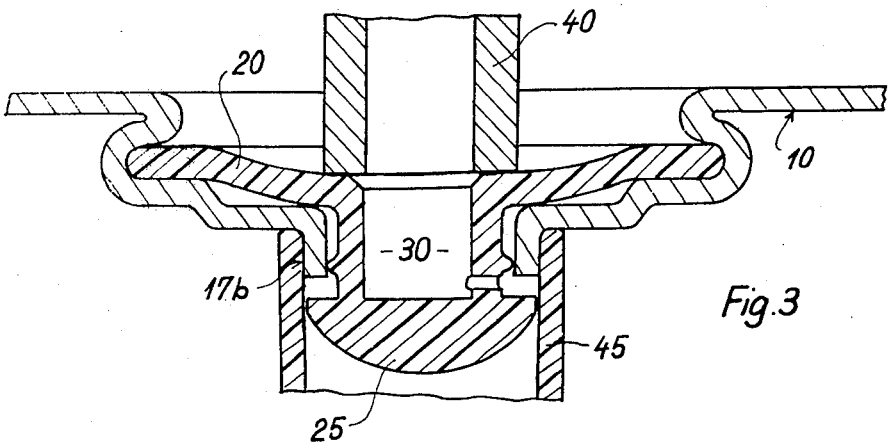
FIG. 3 is a similar view as FIG. 2, showing a first type of actuating means.

In the assembly shown in FIG. 3, the actuating member comprises a separate sleeve 40 which rests on the outer valve disc face 20 and a riser tube 45 is attached to the outside wall 17*b* of collar portion 17. The riser tube 45 must be wide enough to stay clear of valve head button 25 at all times, and can be mounted by widening its internal diameter by heating the tube end, placing it about collar portion 17 and then shrink-seating it on the latter by cooling.

In FIG. 3 and all subsequent Figures, all parts having the same function and practically similar shape as in the embodiment of FIGS. 1 and 2 are designated by like numerals.

Figure 4:
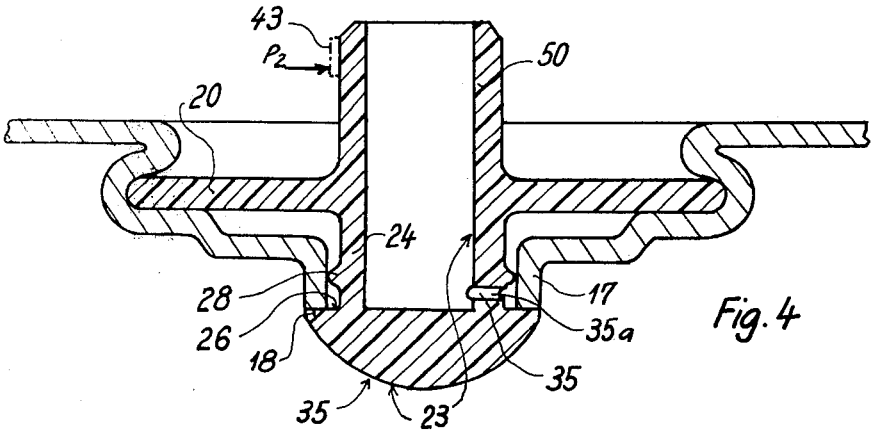
FIG. 4 is another view like FIG. 1, with a different type of actuating means.

In the embodiment shown in FIG. 4, the actuating member is a tubular sleeve 50 integral with the valve disc 20. Duct or ducts 35 are provided only on the right hand side of the stem part 24 in this figure, and correspondingly, a small button or the like projection 43 on the opposite side of sleeve 50 indicates the side on which radial pressure (arrow $P_2$) must be exerted when opening the valve by tilting sleeve 50 and valve head 23 together therewith, to the right in FIG. 4, thereby moving shoulder 26 out of engagement with the right hand zone of rim 18 of collar portion 17 and freeing orifice 35*a*.

Figure 5:
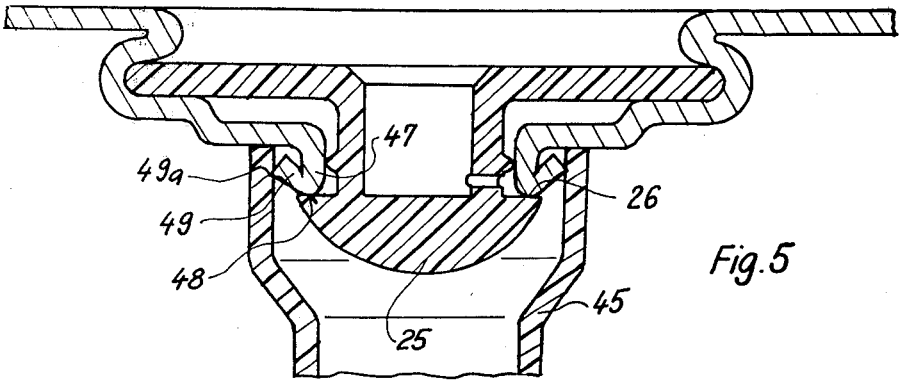
FIG. 5 is a view similar to that of FIG. 1 in which the assembly comprises a riser tube.

FIG. 5 shows an improved way of mounting the riser tube 45 on the collar portion 47. The latter has its lower free end crimped outwardly to provide an outer collar flange 49. The curved crimping bend of the collar portion 47 provides an advantageous configuration for the rim 48 against which shoulder 26 of valve head button 25 abuts with improved sealing effect. At the same time, the outer edge 49*a* of collar flange 49 cuts into the material of the heat-widened top portion of riser tube 45 when the latter is cooled, providing a particular safe hold of the tube on collar flange 49. Also, the riser tube is spaced further away from the shoulder 26 of valve head button 25 than in the embodiment of FIG. 3.

Figure 6:
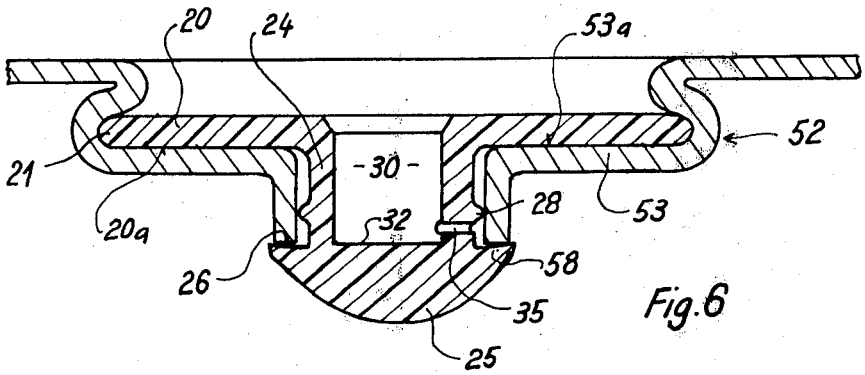
FIG. 6 shows in axial sectional view a different embodiment of the valve-and-lid assembly.

In FIG. 6, there is shown another embodiment in which the underside face 20*a* rests on the flat upper surface 53*a* of flat top wall 53 of dome part 52.

In this embodiment the elastomer material of which the valve disc 20 is made must be particularly longitudinally stretchable, as only then axial pressure exerted on the bottom 32 of cavity 30 will stretch especially the stem part 24 sufficiently to move shoulder 26 of valve head button 25 out of engagement with collar portion rim 58 and free duct 35.

Figure 7:
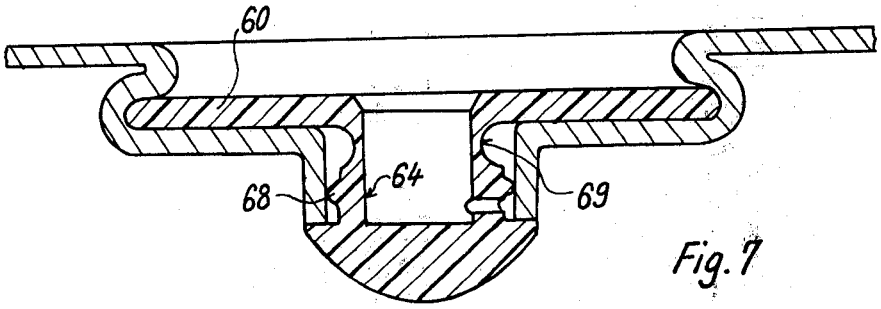
FIGS. 7 and 8 show axial sectional views of details of the valve head.

The stretchability especially of the stem part 64 of valve disc 60 in the embodiment shown in FIG. 7 is further enhanced by providing in the stem part zone above sealing rib 68 an annular zone 69 of reduced thickness.

Figure 8:
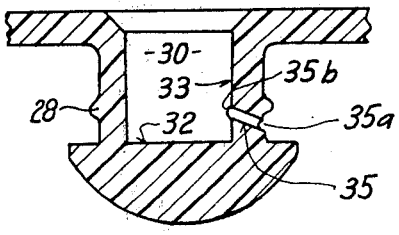

Outflow of product through duct 35 is particularly facilitated by having the duct inclined inwardly and upwardly in the direction of product flow therethrough, (FIG. 8) by having the entry orifice 35*a* located at a lower level, nearer shoulder 26 of valve head button 25 than the exit orifice 35*b* which is located in the inner wall surface 33 of cavity 30 preferably at the same level above the cavity bottom 32 as sealing member 28.

Figure 9:
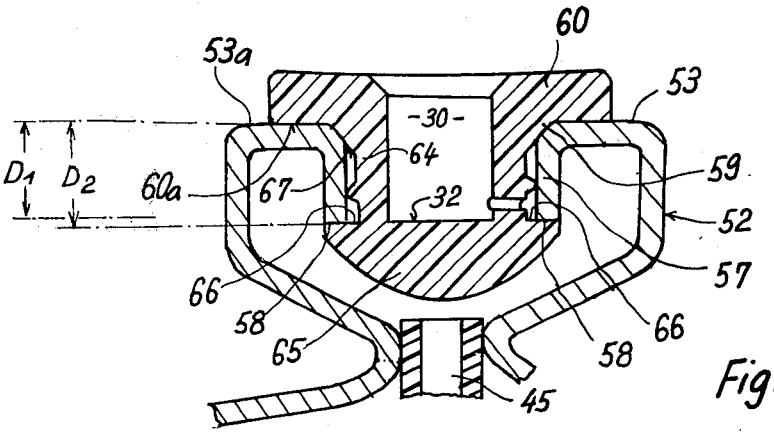
FIGS. 9 and 10 show axial sectional views of a third and of a fourth embodiment.

Especially in an embodiment having no free space intermediate the flat region of valve disc 60 and the dome part top wall 53 underneath the same, a preferred manner of mounting the valve disc in the lid dome part affording a particular firm seat and improved sealing action between the shoulder 66 of valve head button 65 and the rim 58 of collar portion 57 is achieved by providing, at manufacture of the valve disc 60, a distance $D_1$ between the underside face 60*a* of valve disc 60 and shoulder 66 thereof which is smaller prior to mounting the valve disc in the dome part 52, than is the distance $D_2$ between the upper surface 53*a* of flat dome part top wall 53 and the rim 58 of collar portion 57 of the dome part 52 (FIG. 9). By the stretching of the distance $D_1$ to become equal to $D_2$ when mounting valve disc 60 in the dome part 52, there is obtained an additional bias of shoulder 66 against collar portion rim 58. Also, the outer wall zone in which the underside face 60*a* of the valve disc 60 merges with the stem part 64 can be devised as a conically bevelled annular zone 67 which is urged against the bended junction zone of flat top wall 53 with collar portion 57, thus adding an additional contact zone and enhanced biasing and sealing effect to the annular zone 6 which helps to keep valve disc 60 and the upper portion of stem part 64 rigid while only the lower stem part is stretched when opening a gap between elements 58 and 66 by pressure on bottom 32 of cavity 30. In this case the valve disc 60 is held so fast in position in dome part 52 that a crimping of the dome sidewall to clamp in the periphery of valve disc 60 can be dispensed with. In the embodiments of FIGS. 1 to 5 a similar manner of mounting the valve disc in the dome part will not offer quite the same advantages, as the disc will be bent inwardly in closed position, and its path of travel during opening may become too short. In FIGS. 1 and 6 however, the same advantages can be obtained when mounting the valve disc in the dome part in the same manner as in the case of FIG. 9, because the disc periphery 21 is clamped in.

Figure 10:
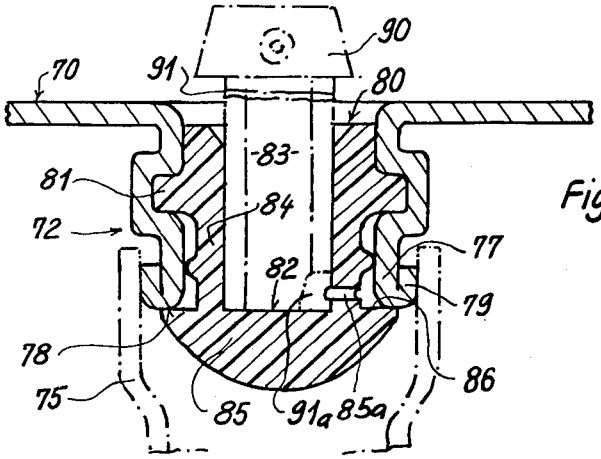

In the embodiment of FIG. 10, the lid 70 has a dome part 72 which contains an annular crimped zone about the peripheral rim 81 of a valve disc 80. The shoulder 86 of valve head button 85 rests firmly against the rounded rim 78 which is formed by crimping the end zone of collar portion 77 upward to form an outer cuff part 79.

Actuation must, in this case, be by means of a hollow sleeve 91 of an actuating head 90 (indicated in phantom lines) which acts upon the bottom 82 of cavity 83 in the valve head stem part 84.

Sleeve 91 is provided with a cutout or port 91*a* at the bottom end thereof to permit product flow from duct 85*a* into the hollow interior of sleeve 91.

A riser tube 75 can be mounted on the cuff part 79 in the same manner as described hereinbefore.

Figure 11:
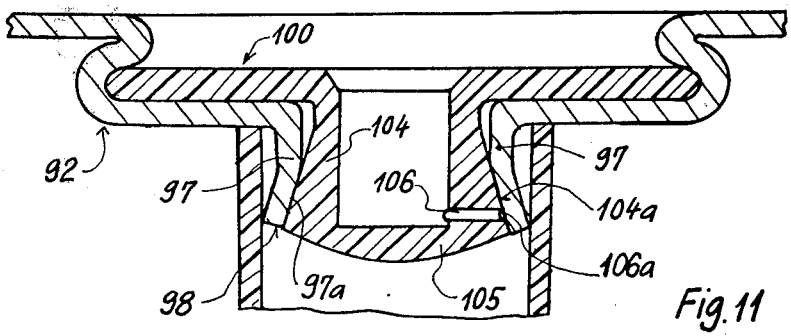
FIG. 11 shows a similar view of a further variation of the embodiment of FIG. 1.

In the embodiment of FIG. 11, the valve disc 100 has a valve head the stem part 104 of which gradually increases in diameter until it merges with the button part 105. Correspondingly, the collar portion 97 of the dome part 92 gradually widens toward the rim 98. Sealing between valve head stem part 104 and the inner surface 97*a* of collar portion 97 is effected by the snug fit of the surface 104*a* of stem part 104 of the said inner surface 97*a*, whereby duct 106 is satisfactorily obturated. A similar actuating member as shown in FIG. 10 can be used to stretch the elastically resilient stem part 104 until the entry orifice 106*a* of duct 106 emerges below the collar portion rim 98, thus opening the valve.

In an attempt to provide for a valve-and-lid assembly according to the invention in which the dome part of the lid does not penetrate so far into the upper space of the can interior 2 as in the preceding embodiments, the embodiment shown in FIG. 12 has a dome part 112 of lid 110 that products upwardly, i.e. away from the can interior 2, and is crimped to clamp in the periphery of a valve disc 120 which bears a valve head 123 with stem part 124 and valve head button 125 similar to these elements shown in FIGS. 1 and 2. The collar portion in this embodiment is constituted by a circular indentation 128*a* in flat lid part 113 about the foot end 112*a* of dome part 112, whereby an annular sealing bead 128 is formed which protrudes downwardly toward the can interior 2 from the underside 113*a* of lid 110. The shoulder 126 of valve head button 125 is urged firmly and sealingly with bias against this sealing bead 128, obturating the duct 135 which extends through stem part 124. The same mounting mode for generating this bias is used as in the case of the embodiment of FIG. 9.

The actuating means of the embodiment of FIG. 10 should be employed also in this case.

The stretchability of the stem part 124 can be improved in the same manner as in the embodiment of FIG. 7.

In FIGS. 13 and 14 there is illustrated a preferred way of mounting a sleeve 191 of spray head 190 in the cavity 30 of valve disc 20. In order to avoid the need for radial adjustment of a port 91*a* (FIG. 10) to register with the exit orifice 35*b* of duct 35, there are provided in the bottom 32 of cavity 30 short radial ribs 32*a* on which the straight bottom rim 192 of sleeve 191 comes to rest.

The spray head sleeve 191 fits snugly into cavity 30 and is held firmly and with good seal against the elastically resilient internal wall surface 33 thereof.

In the embodiment of FIG. 15 the valve head button 125 is covered on its downwardly facing surface 125*a* by a protection cap 29 of corrosion-resistant material.

Figure 16:
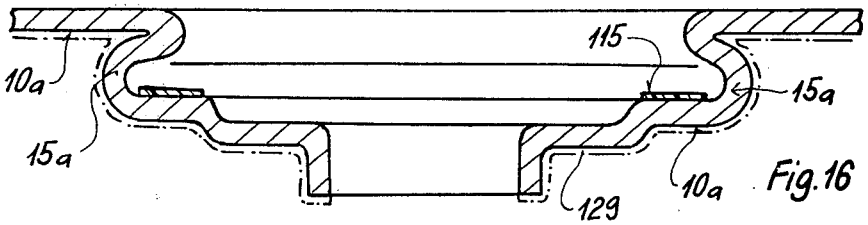
FIGS. 16 and 17 show further details of variations of the lid in the embodiment shown in FIG. 1.

Similarly, in the embodiment of a lid shown in FIG. 16, the downwardly directed lid surface 10*a* which faces toward the can interior 2, can be coated with a similar protective layer 129. In the crimped region 15*a* of the dome part 12, there can be provided rubber elastic sealing strips 115 which can afford an additional sealing effect against the valve disc peripheral portion 21 which is to be clamped into the crimped region 15*a*.

Figure 17:
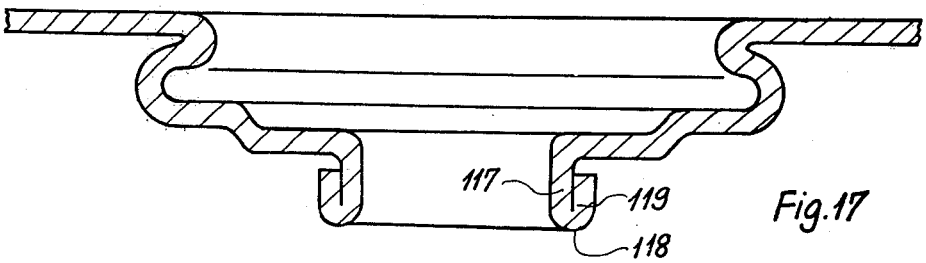

In the embodiment of a lid shown in FIG. 17, the collar portion 117 has an end rim 118 being crimped to have a cuff part 119 thereabout which is similar to that provided in the embodiment of FIG. 10.

Bearing in mind that the material from which the lid is made is, for instance, an aluminium sheet of only 0.6 to 0.8 mm thickness, it will be understood that the cuff 119, or the outer collar flange 49 shown in FIG. 5, contribute significantly to spacing the inner wall of a riser tube affixed to the lower end of the collar portion sufficiently from the valve head button which the riser tube surrounds.

Another advantage of the novel lid according to the invention resides in the fact that the crimped zone in the dome part sidewall can be prefabricated (FIG. 16) and the valve disc bearing the valve head can then be snapped into place inside the dome part with the valve head button protruding through the central dome part opening. Sealing of the valve disc is guaranteed by sealing strips 115, even when the snapped-in valve disc should not fit with complete seal in the prefabricated crimped zone of the dome part.

The protection cap 29 or layer 129 (FIGS. 15 and 16) can be made either of aluminium foil or a hard resin injection molded part, e.g. of a melamin resin or formaldehyde urea resin.

Figure 18:
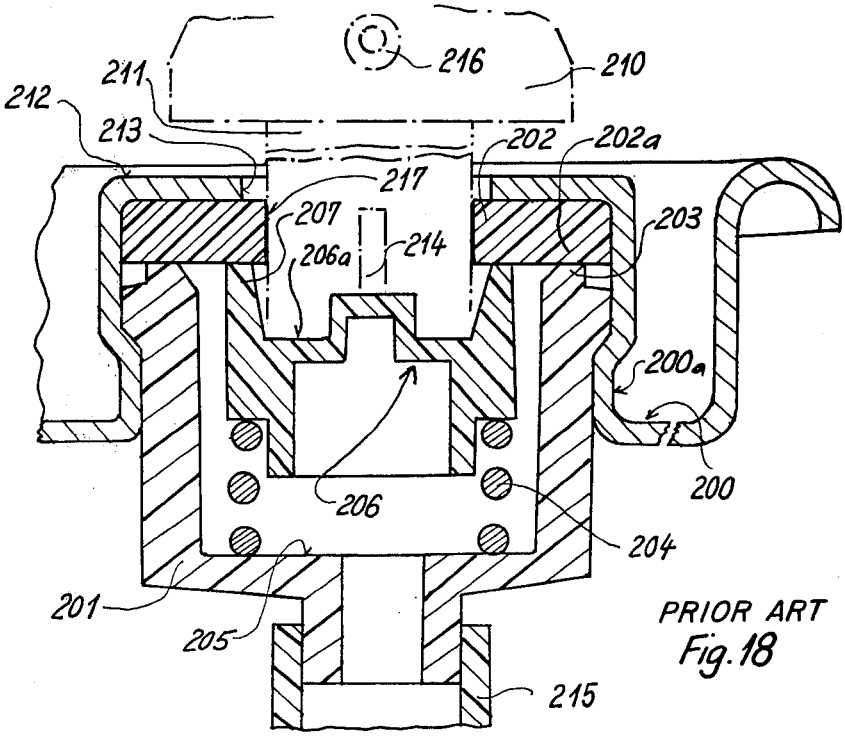
PRIOR ART Fig.18
FIG. 18 shows in axial section a prior art valve-and-lid assembly in a conventional spray can.

The provision of a space 27 (FIGS. 1 and 2) underneath the valve disc 20 inside the dome part 12 has the further advantage that the thickness of the valve disc 20 can be considerably greater than in the conventional gaskets used in the known aerosol spray can valves (see description of gasket 202 in FIG. 18, infra). The wide cavity 30 permits introduction of a filling head or of the stem of an atomizer head without the danger of damaging a functional portion of the valve disc or of having a lacking seal aong the cavity sidewall 33, thus avoiding the fountain effect during filling that is feared when filling a conventional aerosol can through its valve.

Also, in the embodiment of FIG. 4, the sleeve or stem of a filler head or of an atomizer head can be slipped over the tubular sleeve part 50 of valve disc 20 and come to rest with its lower end rim sealingly on the upper valve disc face 20*b*, thus avoiding damage or the above-mentioned undesirable fountain effect.

When fastening the valve disc in the dome part of the lid, with the valve head protruding through the central opening of the collar portion of the dome part, by the method of lengthening the stem part of the valve head when snapping the valve head with bias into position in the dome part as explained in detail in connection with FIG. 9, supra, it is of decisive importance that there be no free space provided between the underside of the flat region of the valve disc and the upper face of the underlying dome part top wall about the valve stem part. For, otherwise, when depressing the valve head, there is danger that the sealing of the periphery of the valve disc on the underlying dome part top wall will become so weak, this periphery not being clamped in, that upon an opening of the valve, liquid product will emerge around the disc periphery in what is called the undesirable "fountain" effect. In the embodiment of FIG. 9, opening pressure exerted in the valve head cavity bottom will increase the sealing effect at the periphery of the valve disc while, at the same time, opening a gap at the valve head button shoulder.

The terms "upward", "downward", "upper side" and "lower side" or "underside" refer to positions of the respective parts as shown in the accompanying drawings, while "inner" and "outer" refer to the container which can be closed by the valve-and-lid assembly according to the invention.

Finally, FIG. 18 shows a conventional valve-and-lid assembly comprising an atomizer head and dependent sleeve as actuating member. Such known valve comprises a lid 200, a valve housing 201 which is held at the lid 200 by means of an indented portion 200*a* of the latter, an elastically resilient valve disc or gasket 202 the peripheral region 202*a* of which is wedged in between a dome top wall 212 and the top rim 203 of valve housing 201. A steel spring 204 one end of which rests on the housing bottom 205, urges a valve body 206 with its upper obturating rim 207 into sealing engagement with the underside of valve disc 202. A sleeve of the atomizer head 210 is inserted into the top opening 213 of dome top wall 212 and rests upon the top face 206a of valve body 206. Depression of the atomizer head 210 compresses the spring 204 and opens a gap betwen the obturating rim 207 and the valve disc 202, whereupon product can flow from a riser tube 215 through valve housing 201 and through the aforesaid gap into a port 214 in sleeve 211 and through the interior of the latter to the spray nozzle 216 in atomizer head 210.

It will be readily understood that it can happen frequently in practice that especially the gasket 202 is damaged when the sleeve 211 or a filling head in the filling station for product or propellant is forced through the orifice 217 of gasket 202 into the valve housing 201 into engagement with the valve body 206.

In contrast thereto, insertion of an atomizer head sleeve or a filler head into the cavity 30 of the valve disc 20 (FIG. 1) and the long sliding insertion thereof along the sidewall 33 of cavity 30 can do little damage.

We claim:

1. Self-closing two-piece valve-and-lid assembly adapted for closing the open top end of a container fillable with pressurized product, and having a central assembly axis, comprising (I) a lid the periphery of which is adapted for being sealingly connected with a top rim of a container sidewall surrounding the said container top opening, and extending generally transverse to said central assembly axis, (i) said lid having a central dome and a central opening in the middle of said lid dome, and being rigid under conditions of filling product into, and discharging product from said container, (ii) said lid extending generally in a main lid plane transverse to said central assembly axis, (iii) said lid dome having a top wall having an outer face and an opposite inner surface facing inward toward the interior of said dome, and a circumferential sidewall which latter extends generally at an angle out of said main lid plane, (iv) said lid dome comprising a collar portion extending axially relative to said central assembly axis and ending in an annular shoulder means about said central dome opening;

(II) a valve body of elasticaly resilient material, comprising (a) a valve disc part having an outer face adapted for facing away from a container and an opposite underside face resting, in a peripheral disc zone, on an annular zone of said inner surface of said dome top wall, (b) a reduced radial diameter valve stem depending from said underside face of said valve disc part and extending axially relative to said central assembly axis, said valve stem having an outer surface;

(c) a valve head at the lower end of, and being of larger radial diameter than, said valve stem, and having an annular face extending in a plane transverse to said central assembly axis, said annular valve head face facing toward said annular shoulder of said collar portion and bearing a first contact zone on said valve head, (d) a cavity being open in said outer face of said disc part forming a rim therein, and extending from said opening axially downward at least into said valve stem and having a bottom end located near the radial plane in which said first contact zone of said valve head extends, (e) additional annular sealing means about said valve stem spaced from said valve head and adapted for making sealing contact at all times with said lid dome collar portion in a second contact zone axially spaced from said first contact zone, (f) duct means in said valve stem, having at least one exit opening for product flow in said cavity and at least one entry opening in a region of the outer surface of said valve stem and head extending from said first to short of said second contact zone thereon, (g) said valve body having a deformable portion thereof located in a region comprising a part of said valve stem above said duct therein and an annular part of said valve disc vicinal to said valve stem, which deformable portion is stretched in axial downward direction toward the interior of a container when said valve-and-lid assembly is opened, '(h) the distance of said annular upward face of said valve head from the underside face of said valve disc part, prior to said valve body being mounted in said lid dome, being shorter than the distance between these same two valve body elements when said valve body is mounted in said lid dome, thereby imparting a bias to said annular upward face of said valve head against said annular shoulder means of said collar portion, thereby biassing said first contact zone of said valve head, when in closed state, into sealing contact with said annular shoulder of said collar portion.

2. The valve-and-lid assembly of claim 1, wherein said actuating means comprise a tubular part on the outer valve disc face and being integral with said disc part, the hollow interior of said tubular actuating part being coaxial with said cavity.

3. The valve-and-lid assembly of claim 1, further comprising a riser tube which is attached to said collar portion on the outside of and below said annular collar shoulder means.

4. The valve-and-lid assembly of claim 1, further comprising actuating means comprising an atomizer head and a sleeve depdnding therefrom, said sleeve being inserted in said cavity, said valve head comprising spacer means located in the bottom of said cavity, the lower end of said sleeve abutting against said spacer means.

5. The valve-and-lid assembly of claim 1, wherein said dome protrudes downwardly from said main lid plane depending from said lid on the side of the latter adapted for being turned toward the interior of a container.

6. The valve-and-lid assembly of claim 1, wherein said stem further comprises annular sealing means radially protruding from said stem outer surface and being slidable on the inner wall of said collar portion, said entry opening of said duct being located between said annular face of said valve head and said sealing means on said stem.

7. The valve-and-lid assembly of claim 6, wherein said cavity extends axially through said stem with the latter constituting a sidewall of the cavity and comprising in said sidewall an annular zone of reduced thickness and thereby being more easily axially stretchable.

8. The valve-and-lid assembly of claim 1, wherein the diameter of said valve disc part is substantially larger than the diameter of said valve head;

wherein said circumferential sidewall of said lid dome comprises an annular crimped region which firmly clamps in said peripheral zone of said valve disc part; and wherein said dome top wall is vaulted away from said main lid plane beyond said crimped sidewall region to provide, about said collar portion, a hollow space between said vaulted top wall and the underside face of said valve disc part inside the clamped-in peripheral zone thereof.

9. The valve-and-lid assembly of claim 1, wherein said valve head has a frustoconical sidewall region into which said cavity extends and which contains said duct, and said collar portion has an outwardly and downwardly flared conical inner wall which is contacted sealingly by said frustoconical sidewall region when these parts are in closing position, while upon axial downward pressure being exercized on the valve body, the frustoconical sidewall region of said valve head slides downward out of contact with said conical inner wall and frees the entry opening of said duct.

10. The valve-and-lid assembly of claim 1, wherein said dome protrudes from said lid on the dome sidewall thereof adapted to face away from said container, said circumferential side having a neck portion below the level of said valve head and comprising a passageway, and wherein said lid further comprises a riser tube having an upper open end mounted in said passageway.

11. The valve-and-lid assembly of claim 9, wherein the valve stem has an upper region which merges with the underside of said valve disc part, and is spaced from the inner wall of the collar portion surrounding said uppper valve stem region.

12. The valve-and-lid assembly of claim 1, wherein said underside face of said valve disc part rests in firm contact on the face of said lid dome top wall turned away from said collar portion thereof.

13. The valve-and-lid assembly of claim 1, wherein said valve stem has an inner sidewall constituting the saidwall of said cavity, and comprises, in said sidewall, an annular zone of reduced thickness and thereby being more easily axially stretchable than the remainder of said valve body.

14. The valve-and-lid assembly of claim 1, wherein said duct is inclined toward said central assembly axis, having its inner end orifice in said cavity and the outer orifice, at the other duct end, in said sidewall of said valve stem near said annular upward face of said valve head, at a level of said stem part below said first inner duct end orifice.

15. The valve-and-lid assembly of claim 1, wherein said annular shoulder means comprises a free rim end of said collar portion below said main lid plane, said rim end being crimped to form an outwardly and upwardly bent marginal portion about said free end.

16. The valve-and-lid assembly of claim 1, wherein said valve head comprises, on the under side thereof turned away from said valve stem, a protective cover of material free from corrosion by corrosive liquid product in prolonged contact with said valve head.

17. The valve-and-lid assembly of claim 1, wherein said lid has a flat part thereof extending in said main lid plane and surrounding said dome, and wherein said dome protrudes upwardly from said main lid plane rising above said flat part on the upper side of said lid facing toward the outside, said collar portion consisting of an annular crimp means about said central opening of said dome, protruding downwardly out of said main lid plane on the underside of said flat lid part and being connected inwardly with said dome.

18. The valve-and-lid assembly of claim 1, wherein said valve stem merges with said underside face of said valve disc in an annular region being inclined at an acute angle relative to the central assembly axis, and said collar portion merges with said top wall of said lid dome in an annular region which supports said inclined annular region of said valve disc when said valve body is in closed as well as in open position.

19. The valve-and-lid assembly of claim 1, further comprising elongated actuating means acting upon one of the rim and bottom end of said cavity for depressing said valve head during opening of said valve-and-lid assembly for the discharge of product from a container, whereby said annular upper face frees said annular shoulder means of said lid dome collar portion and establishes free communication, via said duct means, between the space below said valve head and said cavity in said valve body.

20. A valve body adapted for being mounted in a self closing valve-and-lid assembly adapted for closing the open top end of a container fillable with pressurized product, and said valve-and-lid assembly comprising a rigid lid dome having a collar portion and a valve seat thereon, said valve body comprising (a) a radially extending upper valve body portion having an outwardly facing upper surface and a lower surface destined for facing inwardly toward the container;

(b) a valve stem centrally and axially protruding at least from a first one of said upper body portion surfaces and adapted for being lodged in said collar portion, said valve body having a central axis normal to said upper surface of said upper valve body portion and extending through said valve stem;

at least one of said upper valve body portion and said valve stem having an annular elastically resilient valve portion being deformable toward or in, axial direction, (c) a valve head at an end of said valve stem remote from said upper valve body portion and having a diameter, transverse to said central axis, which is larger than the diameter of said valve stem; said valve head having an upwardly turned face bearing a first annular contact zone located thereon as to face toward said upper valve body portion and being adapted for making sealing contact with said valve seat, in closed position;

(d) a cavity having an opening in said upper surface of said upper valve body portion and extending axially at least into said valve stem and having a bottom end located near the radial plane in which said first contact zone on said valve head extends, (e) additional annular sealing means about said valve stem spaced from said valve head and adapted for making sealing contact at all times with said rigid collar portion in a second contact zone axially spaced from said first contact zone, (f) and duct means in said valve stem, having an exit opening for product flow in said cavity and an entry opening in a region of the outer surface of said valve stem extending from said first to short of said second contact zone.

21. The valve body of claim 20, wherein said valve head comprises, on the terminal face thereof turned away from said stem, a protective cover of material resisting corrosion by corrosive liquid product in prolonged contact with said valve button head.

22. The valve body of claim 20, which consists essentially of a synthetic resin material selected from the group consisting of a polyester elastomer of the Hytrel 4055 type and an ethylene-vinyl acetate copolymer resin of the Elvax 3120 type.

23. The valve body of claim 20, wherein said stem has a sidewall constituting the sidewall of said cavity, and comprising in said sidewall an annular zone of reduced thickness, thereby rendering said valve stem more axially stretchable.

24. The valve body of claim 20, wherein said valve head comprises, on the terminal face thereof turned away from said stem, a protective cover of material resisting corrosion by corrosive liquid product in prolonged contact with said valve button head.

25. The valve body of claim 20, wherein said stem merges with said lower surface of said upper valve body portion in an annular region which is inclined at an acute angle relative to the central valve body axis.

* * * * *